United States Patent [19]

Ganson et al.

[11] Patent Number: 4,815,715

[45] Date of Patent: Mar. 28, 1989

[54] GAS PURGING ASSEMBLY FOR SUPPLYING GAS TO MOLTEN METAL IN A METALLURGICAL VESSEL

[75] Inventors: Dietmar Ganson; Heinz Schüze, both of Houston; Mel Zetz, Grand Prairie, all of Tex.

[73] Assignee: Didier-Werke AG, Wiesbaden, Fed. Rep. of Germany

[21] Appl. No.: 107,362

[22] Filed: Oct. 9, 1987

[30] Foreign Application Priority Data

Oct. 9, 1986 [DE] Fed. Rep. of Germany ..... 3634448

[51] Int. Cl.[4] ..... C21C 5/48

[52] U.S. Cl. ..... 266/268; 266/220; 266/266

[58] Field of Search ..... 266/218, 220, 221, 222, 266/224, 265, 266, 268, 270

[56] References Cited

U.S. PATENT DOCUMENTS 3,802,684 4/1974 Rote ..... 266/268

4,157,817 6/1979 Moyaux et al. ..... 266/268

FOREIGN PATENT DOCUMENTS 648343 2/1979 U.S.S.R. ..... 266/220

*Primary Examiner*—L. Dewayne Rutledge

*Assistant Examiner*—Robert L. McDowell

*Attorney, Agent, or Firm*—Wenderoth, Lind & Ponack

[57] ABSTRACT

An assembly for use in supplying a gas through a metallurgical vessel into molten metal contained therein includes a refractory supporting block to be mounted within a wall or a bottom of the metallurgical vessel. The supporting block has an inner end directed toward the molten metal and an outer end directed outwardly of the metallurgical vessel. A plurality of receiving chambers extend into the supporting block from the inner end thereof, and each of a plurality of purging bricks is fitted within a respective receiving chamber. A connecting plate is mounted on the outer end of the supporting block for connection to a source of purging gas. A plurality of channels extend through the supporting block from the connecting plate to respective of the receiving chambers and purging bricks.

9 Claims, 2 Drawing Sheets

GAS PURGING ASSEMBLY FOR SUPPLYING GAS TO MOLTEN METAL IN A METALLURGICAL VESSEL

BACKGROUND OF THE INVENTION

The present invention relates to a gas purging assembly or device for supplying gas to molten metal through a bottom or a side wall of a metallurgical vessel.

In such a device or assembly gas is blown into the molten metal. This type of device or assembly includes a gas permeable purging brick which becomes consumed by the molten metal during operation. When the purging brick has become consumed, the operation of the vessel must be stopped and the vessel must be drained and cooled so that the purging brick can be replaced. The shorter the service life of the purging brick, the more frequently must the operation of the metallurgical vessel be interrupted. It is desirable that there be as few stoppages of the operation of the metallurgical vessel as possible.

SUMMARY OF THE INVENTION

Accordingly, it is an object of the present invention to provide a purging device or assembly having an increased service life whereby it is possible to reduce the frequency at which operation of the metallurgical vessel need be interrupted. This object is achieved in accordance with the present invention by the provision of an assembly including a refractory supporting or retaining block to be mounted within a wall or a bottom of a metallurgical vessel. The supporting block has an inner end to be directed toward the molten metal and an outer end to be directed outwardly of the metallurgical vessel. A plurality of receiving chambers are formed in the supporting block to extend into the supporting block from the inner end thereof. A plurality of gas permeable purging bricks are fitted within respective of the receiving chambers, one brick within each receiving chamber. A connecting plate is mounted on the outer end of the supporting block for connection to a source of purging gas, and a plurality of channels extend through the supporting block from the connecting plate to respective of the receiving chambers and bricks. Accordingly, the source of gas may be connected through the connecting plate to a selected one of the channels and supplied therethrough to and through the respective purging brick to the molten metal.

In accordance with the assembly of the present invention, the plurality of purging bricks can be placed successively in service. After a first purging brick has become eroded and/or consumed, the supply of gas to such purging brick is stopped and then is connected to another one of the purging bricks which thereafter is used until it is consumed. This operation is repeated until the plurality of purging bricks have been consumed. Only then need the operation of the metallurgical vessel be stopped.

The assembly of the present invention provides the further advantage of reducing the danger of leakage or break-out of the molten metal. Thus, the purging bricks of the present invention are enclosed or surrounded by the supporting block which thus prevents molten metal break-out.

BRIEF DESCRIPTION OF THE DRAWINGS

Other objects, features and advantages of the present invention will be apparent from the following detailed description of a preferred embodiment thereof, taken with the accompanying drawings, wherein.

DETAILED DESCRIPTION OF THE INVENTION

Figure 1:
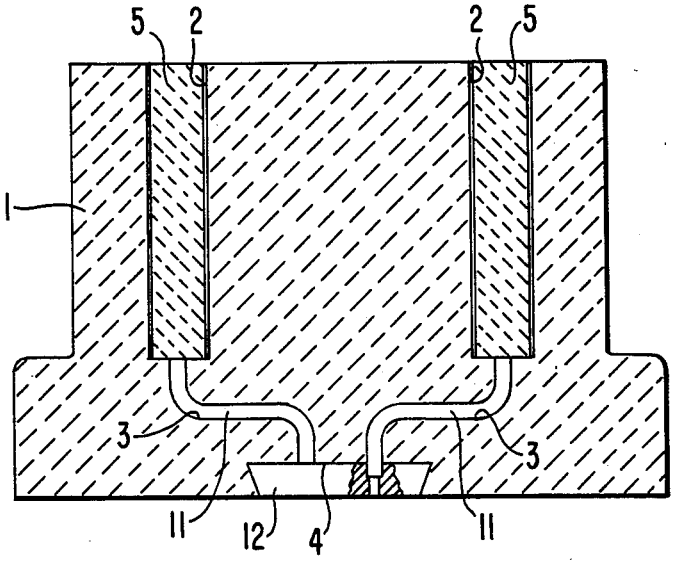
FIG. 1 is a cross-sectional view through a gas purging assembly according to the present invention.

FIG. 1 illustrates one embodiment of a gas purging assembly according to the present invention and including a refractory retaining or supporting block 1 to be mounted within a wall or a bottom of a metallurgical vessel and having an inner end (the upper end shown in FIG. 1) to be directed toward the molten metal and an outer end (the lower end in FIG. 1) to be directed outwardly of the metallurgical vessel. A plurality of receiving chambers 2 are formed in the supporting block 1 and extend thereinto from the inner end thereof. A plurality of gas permeable purging bricks 5 are fitted within respective of the receiving chambers 2. Although the illustrated embodiment shows three chambers 2 and bricks 5, it of course would be understood that this exemplary only and that two or more than three may be provided.

Figure 2:
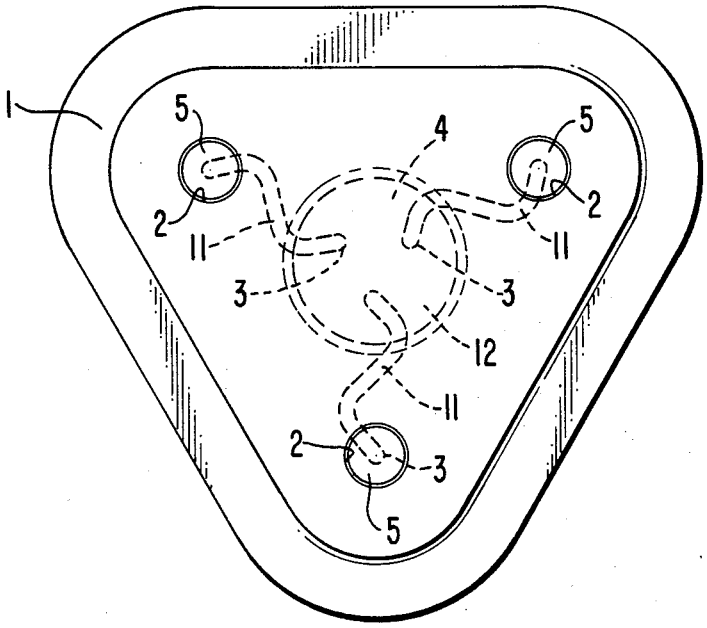
FIG. 2 is a plan view of such assembly.

In the outer end of supporting block 1 is formed a recess 4 within which is fitted a metal connecting plate 12, for example formed of a suitable steel, and having therethrough a plurality of openings to be connected to a source of purging gas. A plurality of channels 3 extend generally spirally as shown in FIGS. 1 and 2 through supporting block 1 from connecting plate 12 to the inner ends of respective chambers 2. Accordingly, the source of gas may be connected through connecting plate 12 to a selected channel 3 and be supplied therethrough to and through the respective brick 5 and then into the molten metal within the metallurgical vessel.

Figure 3:
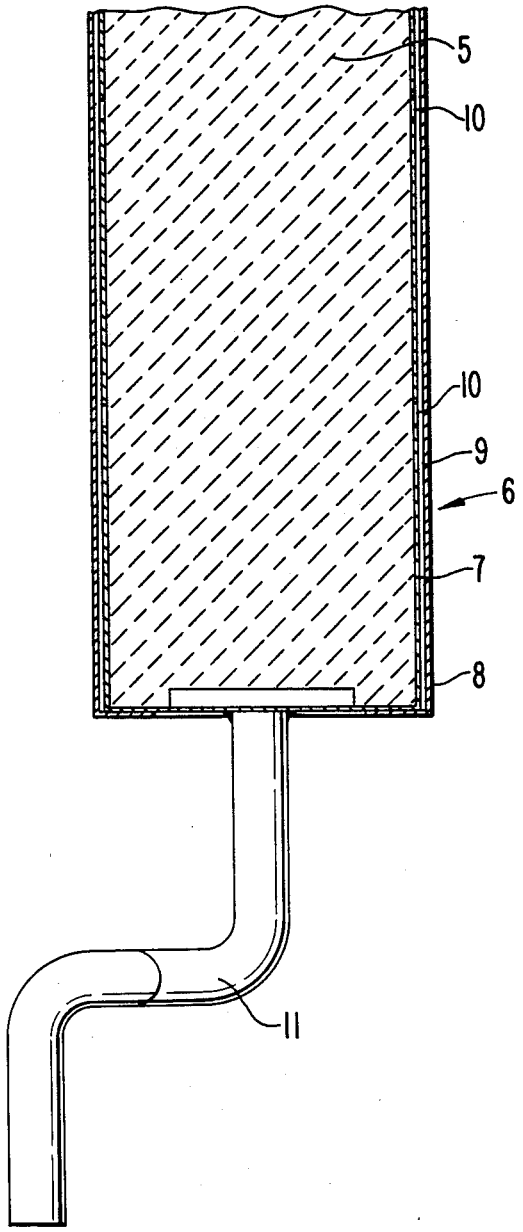
FIG. 3 is an enlarged sectional view of one of the purging bricks and elements connected thereto shown in FIG. 1.
Figure 4:
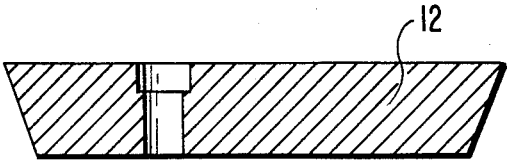
FIG. 4 is a sectional view of a connecting plate shown in FIG. 1.

As shown in FIG. 3, each purging brick 5, formed of a gas permeable ceramic material, is surrounded by a double wall jacket 6 including an inner wall 7 and an outer wall 8 defining therebetween a gap 9 which is open to the metallurgical vessel. Openings 10 are formed in inner cylinder 7, and as a result some of the purging gas supplied to brick 5 passes through openings 10 into gap 9 and then to the molten metal.

As further illustrated in the drawings, a plurality of gas lines 11 extend through respective channels 3 and are attached to respective bricks, and particularly to the respective jackets 6, for example by welding. Gas lines 3 also are connected, for example by welding, to connecting plate 12.

Upon formation of the assembly of the invention, the purging bricks 5 are pushed into the respective receiving chambers 2, and during such operation the respective metal gas lines 11, for example in the form of copper tubes, are pushed through the respective channels 3 until they reach the connecting plate 12, after which the gas lines 11 are welded to the connecting plate 12.

Preferably the receiving chambers 2 and bricks 5 are of cylindrical configuration as illustrated in the drawings. Furthermore, the supporting block 1 preferably is formed of a gas impermeable ceramic material, thereby providing protection against the danger of molten metal break-out upon consumption of the respective bricks 5.

Upon operation of the assembly of the present invention, one of the gas lines 11 is connected at the connecting plate 12 with the source of gas. The purging gas then flows through the line 11 and through the respective purging brick 5 into the molten metal. A partial stream of the gas passes through openings 10 and gap 9 and flows therethrough. As a result, there is created, on the one hand, additional gas supply to the molten metal and, on the other hand, a protective atmosphere surrounding or shielding the supporting block 1. After such purging brick 5 has become eroded, as inevitably occurs, then the gas supply to the respective gas line 11 of such brick is interrupted and then is connected to another of the gas lines, whereafter gas then is supplied to the molten metal through the brick 5 associated with such gas line. Only after the consumption of all of the purging bricks 5 need the operation of the metallurgical vessel be interrupted.

Although the present invention has been described and illustrated with respect to a preferred embodiment, it is to be understood that various changes and modifications may be made to the specifically described and illustrated features without departing from the scope of the present invention

We claim:

1. An assembly for use in supplying a gas through a metallurgical vessel into molten metal contained therein, said assembly comprising:

a refractory supporting block to be mounted within a wall or a bottom of a metallurgical vessel, said supporting block having an inner end to be directed toward the molten metal and an outer end to be directed outwardly of the metallurgical vessel;

a plurality of receiving chambers extending into said supporting block from said inner end thereof;

a plurality of gas permeable purging bricks, each said purging brick being fitted within a respective said receiving chamber;

a connecting plate mounted on said outer end of said supporting block, and having therethrough a plurality of openings for selective sequential connection to a source of gas; and a plurality of channels extending through said supporting block from respective said openings in said connecting plate to respective said receiving chambers and bricks;

whereby the source of gas may be connected through a selected said opening in said connecting plate to a respective said channel and be supplied therethrough to and through the respective said brick to the molten metal.

2. An assembly as claimed in claim 1, further comprising a plurality of gas lines extending through respective said channels and attached to respective said bricks.

3. An assembly as claimed in claim 2, wherein each said gas line is connected to said connecting plate.

4. An assembly as claimed in claim 3, wherein each said gas line is welded to said connecting plate.

5. An assembly as claimed in claim 2, wherein said bricks are surrounded by respective double wall jackets, and said gas lines are connected to respective said jackets.

6. An assembly as claimed in claim 5, wherein said gas lines are welded to respective said jackets.

7. An assembly as claimed in claim 5, wherein each said jacket comprises inner and outer walls defining therebetween a gap open to the molten metal, and each said inner wall has therethrough openings into said gap, whereby a portion of the gas supplied through the respective said brick passes through said openings into said gap and therefrom to the molten metal.

8. An assembly as claimed in claim 1, wherein said receiving chambers and said bricks are of cylindrical configuration.

9. An assembly as claimed in claim 1, wherein said supporting block is formed of a gas impermeable ceramic material.

* * * * *